United States Patent [19]

Bush et al.

[11] 4,261,486

[45] Apr. 14, 1981

[54] ONE-PIECE DISPENSING CLOSURE WITH LID HOLD-OPEN FEATURE

[75] Inventors: Randall G. Bush; Gary V. Montgomery, both of Evansville, Ind.

[73] Assignee: Sunbeam Plastics Corporation, Evansville, Ind.

[21] Appl. No.: 64,074

[22] Filed: Aug. 6, 1979

[51] Int. Cl.[3] ..... B65D 47/08

[52] U.S. Cl. ..... 222/517; 16/150; 222/543; 222/563

[58] Field of Search ..... 215/235; 222/153, 511, 222/517, 543, 562, 563, 565; 16/150

[56] References Cited

U.S. PATENT DOCUMENTS

| | | | |
|---|---|---|---|
| 3,059,816 | 10/1962 | Goldstein | 222/543 X |
| 3,131,824 | 5/1964 | Van Baarn | 222/565 X |
| 4,010,875 | 3/1977 | Babiol | 222/517 |
| 4,127,221 | 11/1978 | Vere | 222/543 X |
| 4,158,902 | 6/1979 | Chernack et al. | 222/517 X |

FOREIGN PATENT DOCUMENTS

| | | | |
|---|---|---|---|
| 2658805 | 4/1978 | Fed. Rep. of Germany | 222/562 |
| 2407140 | 6/1979 | France | 222/543 |

*Primary Examiner*—David A. Scherbel

*Attorney, Agent, or Firm*—Fisher, Gerhardt, Crampton & Groh

[57] ABSTRACT

A one-piece dispensing closure has an annular skirt on the inner side of which there are threads which co-operate with threads on a container neck for retaining the closure on the container. The closure has a disc-like top in which there is a dispensing opening and a lid for the opening which is an integral part of the closure and is hinged to the closure top at one edge thereof. The lid has an integral plug adapted to close the dispensing opening when the lid is swung into closing position overlying the closure top. The closure top and the underside of the lid have co-operating projections, for example, ears and a post, which function to prevent the lid from swinging to closing position when the closure is turned over to position for dispensing content material and which can be manually interengaged for retaining the lid in closing position when desired.

6 Claims, 12 Drawing Figures

FIG. 1
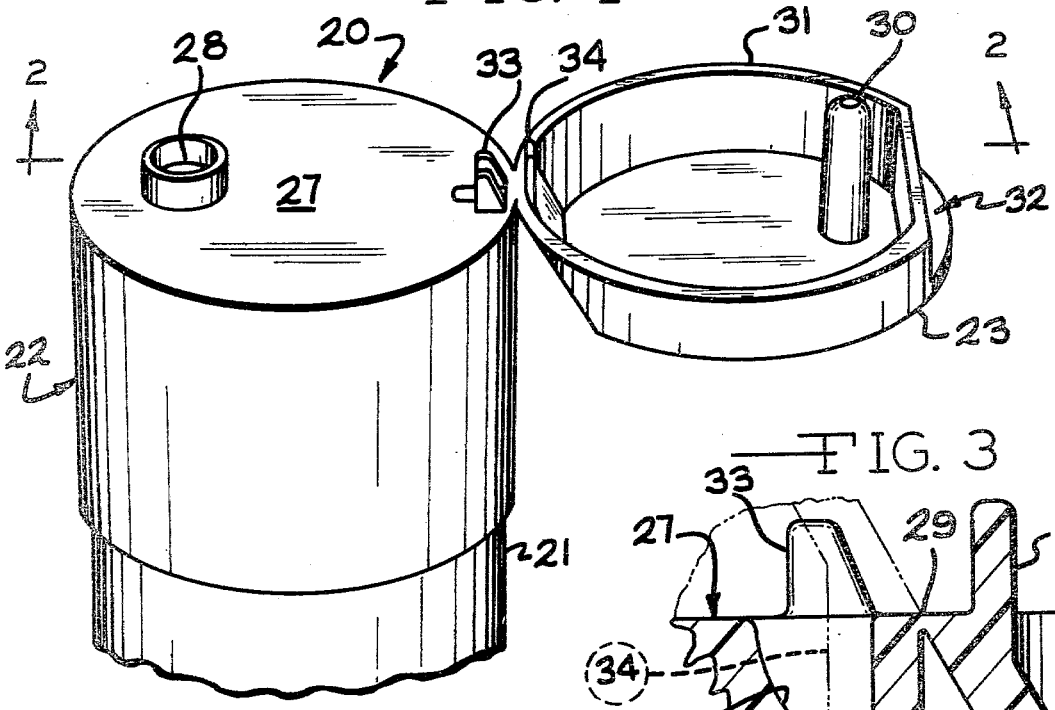
FIG. 3
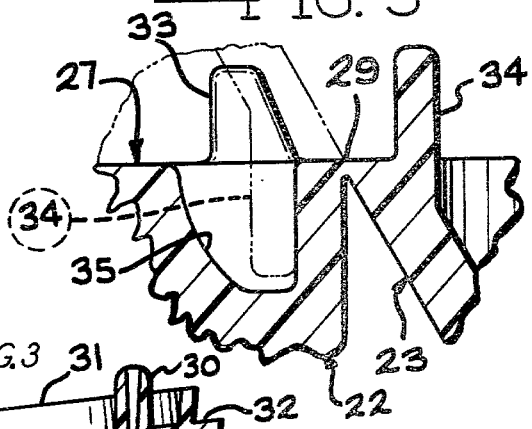
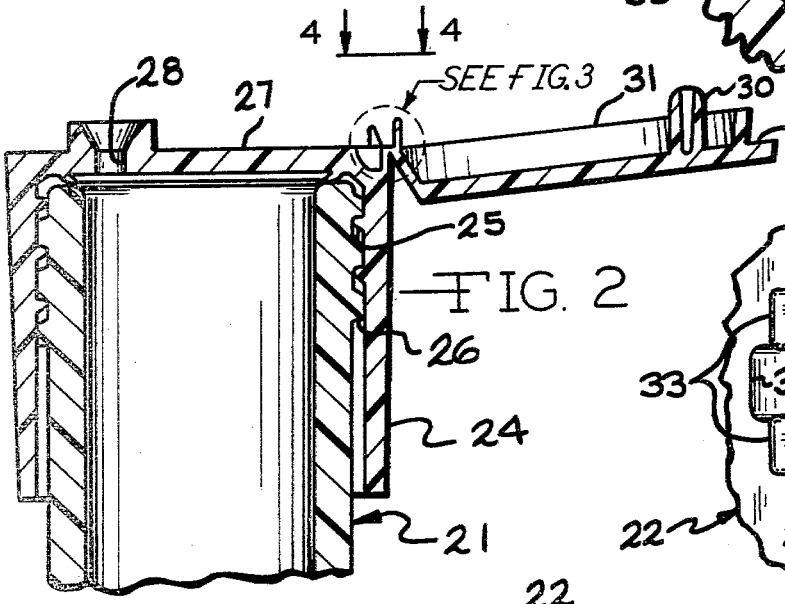
FIG. 2
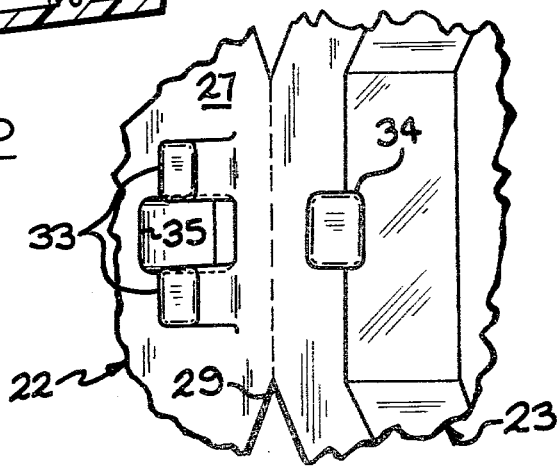
FIG. 4
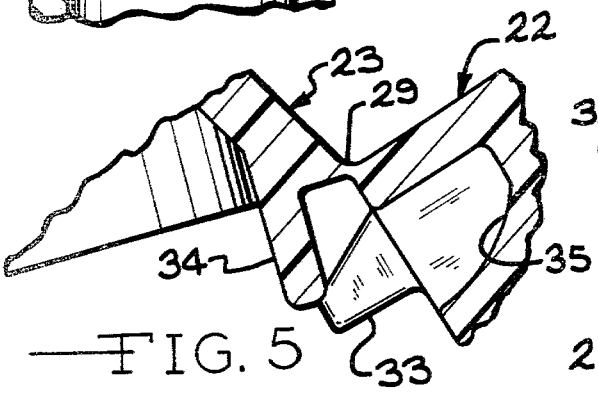
FIG. 5
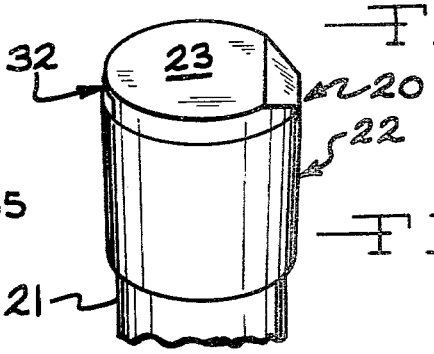
FIG. 6

FIG. 7
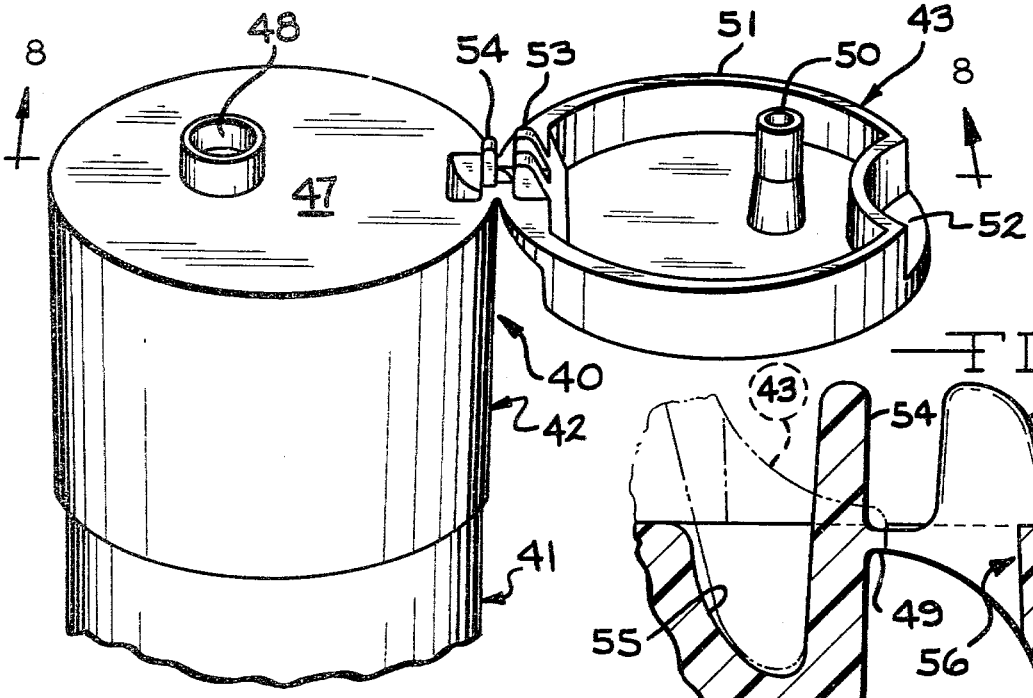
FIG. 9
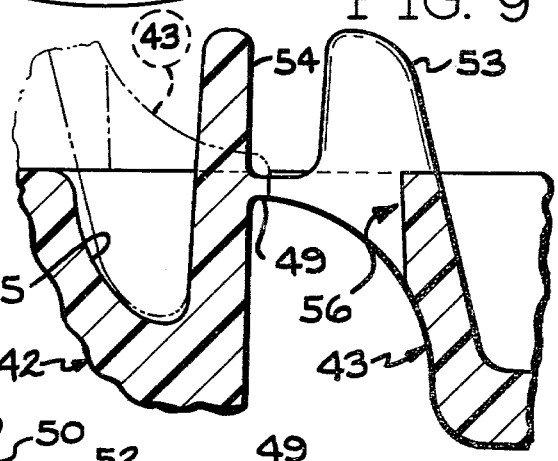
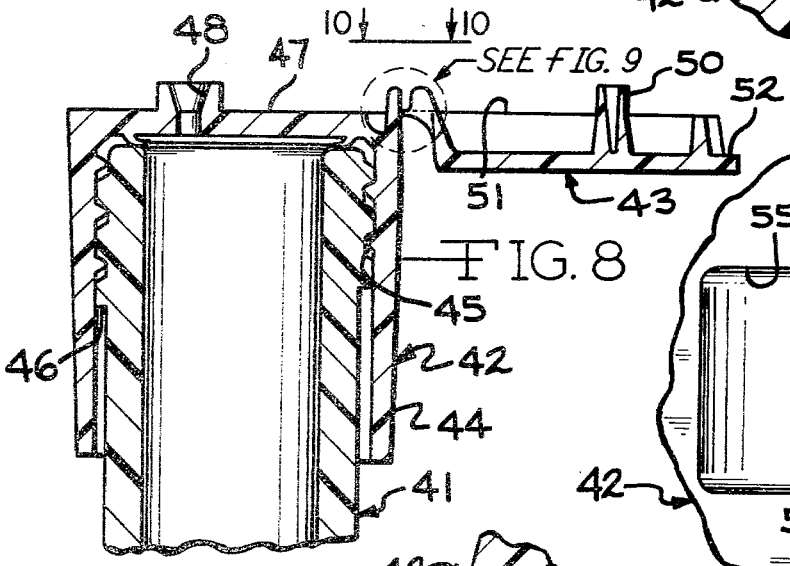
FIG. 8
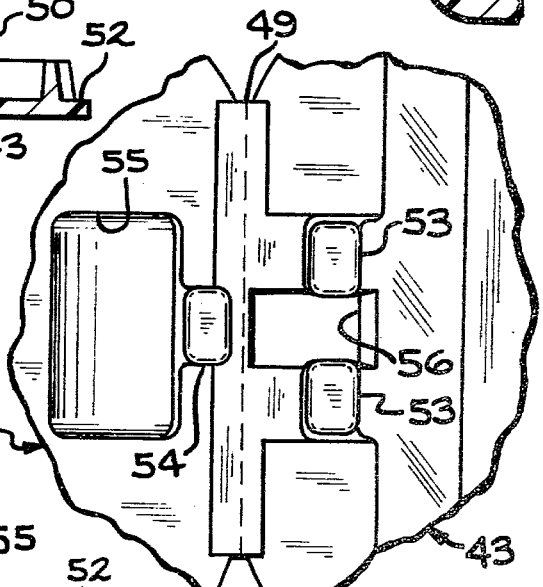
FIG. 10
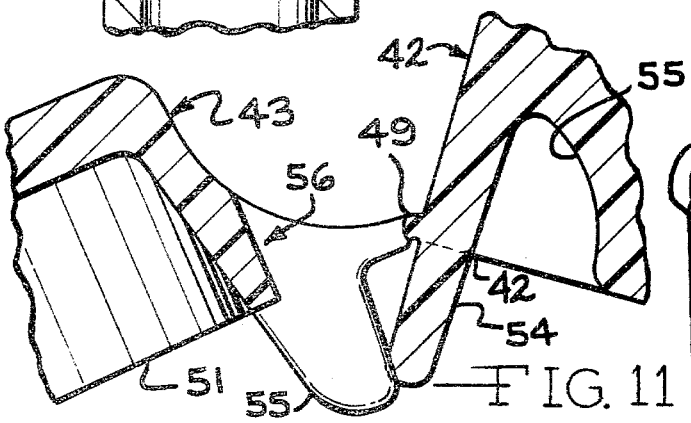
FIG. 11
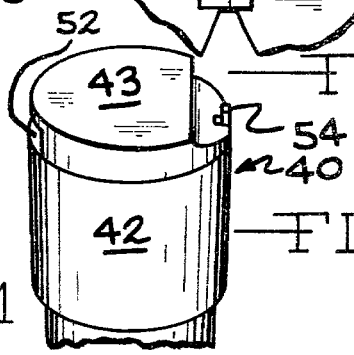
FIG. 12

ONE-PIECE DISPENSING CLOSURE WITH LID HOLD-OPEN FEATURE

BACKGROUND OF THE INVENTION

Many liquid materials such as hand lotions, shampoo, dishwashing liquids, waxes, cleaning fluids, etc. are packaged in containers from which it is desired that the content materials should be dispensed in relatively small quantities.

A container or bottle for such a material often is provided with a cap or closure which has a small dispensing opening and a sealing device, for example, a stopper or plug, for that opening. The stopper or plug usually is manually moveable from a position closing the opening to a position which permits materials to be dispensed through the opening. Many of the closures for materials of this type consist of two separate parts, the plug or stopper being moveable relative to the main body of the closure to open and close the dispensing orifice. Usually the movement of the plug from closed to open, or dispensing, position requires the use of both hands, one to hold the container and the second to move the plug or stopper. Two part closures are relatively expensive because of the necessity for having two expensive molds and, often, a manual operation to assemble the two parts to each other.

It is the principal object of the invention to provide a one-piece dispensing closure for containers of materials of the type mentioned, all portions of the closure being integral with each other.

A second object of the invention is to provide a one-piece dispensing closure which can be molded, for example, from a resinous material by the use of a mold having a single cavity, thus reducing the cost of the molds necessary to produce the finished closure and eliminating the necessity for manual operations in order to assemble two parts to each other.

It is yet another object of the invention to provide a one-piece dispensing closure for the neck of a container such as a bottle in which the dispensing closure can be opened by the fingers of the same hand which is holding the container.

A further object of the invention is to provide a dispensing closure in which the cap and plug for closing the dispensing opening is held out of interfering position when the container is inverted for the purpose of dispensing its content material.

BRIEF DESCRIPTION OF THE DRAWINGS

FIG. 1 is a view in perspective of a one-piece dispensing closure embodying the invention and fragmentarily shows a portion of a neck of a container with which the closure is used;

FIG. 2 is a fragmentary view in vertical section taken substantially along the line 2—2 of FIG. 1;

FIG. 3 is a greatly enlarged, fragmentary view of a portion of a closure embodying the invention, particularly illustrating the hinged portion;

FIG. 4 is a fragmentary, horizontal plan view taken from the position indicated by line 4—4 of FIG. 2;

FIG. 5 is a view similar to FIG. 3 but showing the closure elements in a different position;

FIG. 6 is a view in perspective on a smaller scale showing the closure of FIG. 1 in closed position;

FIG. 7 is a view similar to FIG. 1 but showing a second embodiment of the invention;

FIG. 8 is a fragmentary, vertical section view taken along the line 8—8 of FIG. 7;

FIG. 9 is a greatly enlarged, fragmentary view in vertical section of a hinged portion of this second embodiment;

FIG. 10 is a fragmentary, horizontal plan view taken from the position indicated by line 10—10 of FIG. 8;

FIG. 11 is a view similar to FIG. 9 but showing the closure elements in a different position; and FIG. 12 is a view similar to FIG. 6 but showing the second embodiment of the invention with the closure of FIG. 7 in closed position.

DESCRIPTION OF PREFERRED EMBODIMENTS

A closure 20 embodying the invention is shown in its position on a container neck 21 which is fragmentarily illustrated in the various figures. The closure 20 consists of two major parts which are a cap 22 and a lid 23. The closure 20 has an annular skirt 24 on the inner side of which are molded closure retaining means such as threads 25 which cooperate with similar threads 26 on the container neck 21.

The cap has a disc-like top 27 and there is an axially-extending dispensing orifice 28 through the top 27.

The lid 23 is an integral part of the closure and is connected to the cap top 27 by a thin flexible web which constitutes a hinge 29. The hinge 29 extends tangentially to the top 27 and is normal to a diametric line through the dispensing orifice 28.

The lid 23 has an orifice plug 30 of such size and so spaced from the hinge 29 along the diametric line that when the lid 23 is swung over into the closed position overlying the top 27, the plug enters the dispensing orifice 28 to close that opening.

The cap 23 also has a rim 31 of outside diameter substantially equal to the outside diameter of the closure top 27 with a portion opposite the hinge 29 being cut back thus to form an undercut recess 32. As can be seen particularly be reference to FIG. 6, when the lid 23 is in closed position overlying the top 27 with the plug 30 closing the orifice 28, the undercut recess 32 is engageable, for example, by the fingernail or thumb nail of the same hand which is holding the container. The lid 23 then may be flipped over in order to open the dispensing orifice 28.

In order to prevent the lid 23 from interfering with the stream of material being dispensed, a closure according to the invention comprises means for preventing the lid 23 from swinging down into a position where the stream of material would strike the lid, sometimes creating an undesirable mess. These means consist of opposed, engageable, cooperating elements on the cap 22 and lid 23. In this embodiment, these means are a pair of ears 33 extending upwardly from the closure top 27 and a post 34 on the lid 23. As best can be seen in FIG. 4, the space between the two ears 33 is less than the width of the post 34 which is centered on a diametric line through the orifice 28 and the plug 30.

The spacing of the ear 33 and post 34 from the hinge line 29 and their respective heights are such that when the lid 23 tends to extend into the discharged stream of material, the post 34 engages the two ears 33 as shown in FIG. 5 and holds the lid 23 up and out of the way.

When it is desired finally to close the orifice 28, the individual swings the lid 23 all the way over to the position shown in FIG. 6, squeezing the post 34 downwardly between the ears 33 and into a recess 35 (see also FIG. 3) that is located between the ears 33 in the closure top 27 and inserting the plug 30 to seal the orifice 28.

FIGS. 7–12, inclusive, show a second embodiment of a dispensing closure according to the invention.

A closure 40, like the closure 20 of FIGS. 1–6, is shown in position on a container neck 41 and consists of a cap 42 and a lid 43. The cap 42 has an annular skirt 44 which has threads 45 on its inner side, the threads 45 cooperating with threads 46 on the container neck 41 for retaining the closure 40 on the container.

The cap 42 has a disk-like top 47 through which there is an axially-extending dispensing orifice 48.

The lid 43 is integrally connected to the cap 42 by a narrow web forming a hinge 49 and has a plug 50 for the dispensing orifice 48 on its underside. The hinge 49 is generally tangential to the adjacent edges of the top 47 and lid 43 and is normal to a diametric line through the dispensing orifice 48 and its plug 50, with the orifice 48 and plug 50 being spaced equidistantly from the center line of the hinge 49.

The cap 42 has a generally circumferentially extending rim 51 which is cut back at the side opposite the hinge 49 to provide an undercut recess 52. When the lid 43 is swung over into closed position, as illustrated in FIG. 12, the recess 52 provides a space into which a person seeking to remove the lid 43 may insert his thumb nail or an instrument for raising the lid 52.

As in the case of the embodiment of the invention illustrated in FIGS. 1–6, inclusive, in this embodiment the cap 42 and lid 43 have cooperating engageable elements for preventing the lid 43 from swinging downwardly into position to interrupt the flow of content material out of the orifice 48. These means are spaced ears 53, in this case molded near the edge of the lid 43, and a post 54 positioned oppositely thereto near the edge of the cap top 47. As in the earlier embodiment of the invention, when the container and closure are inverted (see FIG. 11) the ears 53 and the post 54 engage each other to prevent the lid 43 from swinging over into obstructing position.

Also, as in the earlier embodiment, there is a recess 55 formed in the cap top 47 which receives the ears 53 when the lid 43 is swung over to closed position, as shown in FIGS. 9 and 12.

In addition, the lid 43 of this embodiment has an opening 56 through which the post 54 protrudes when the lid 43 is swung over into closed position, as shown in FIG. 12.

Having described my invention we claim:

1. In a one-piece dispensing closure for a container having a body and a tubular neck, said closure having an annular skirt and there being co-operating retaining means on said neck and on the inner surface of said skirt, the improvement comprising:

(a) a disc-like top of said closure having a dispensing orifice therethrough and (b) a lid for said orifice that is a unitary portion of said closure and that is connected to said closure along a hinge line tangential to one edge of said top by a thin, flexible web of material, said web being diametrically spaced from said orifice, (c) said lid having a closed disc-like top and a plug which is so spaced and of such size as to extend into and close said orifice when said lid is swung over on said hinge into superposed, closing position overlying said closure, (d) at least one projection on each of the upper side of said closure top and on the under side of said lid top, said projections being equidistantly spaced on opposite sides of the hinge line and being of such size as to engage each other for preventing said lid from moving into position to obstruct the flow of material from said orifice and said projections being moved into frictional engagement of overlapping generally diametrically extending sides thereof when said lid is moved into closing position overlying said closure top for retaining said lid in closing position with said plug closing said orifice.

2. A one-piece dispensing closure according to claim 1 in which there is an undercut beneath the disc-like top of the lid at a position remote from the hinge.

3. A one-piece dispensing closure according to claim 1 in which the lid has an axially-extending rim of outer diameter substantially equal to the outer diameter of the disc-like top of the closure.

4. A one-piece dispensing closure according to claim 3 in which the plug has an axial length greater than the axial width of the rim.

5. A one-piece dispensing closure according to claim 1 in which said projections are (a) a pair of ears which are spaced from each other along a line parallel to the hinge line and which are spaced radially from one side of the hinge line and (b) a post which is radially aligned with the space between said ears and is of a size such as to engage the inner sides of both of said ears when the lid is swung over into closed position.

6. A one-piece dispensing closure according to claim 5 in which that one of the top of the closure or the lid which has the ears also has a recess therein for the reception of the post when the said lid is swung over into closed position.

* * * * *